US006329622B1

(12) United States Patent
Ando

(10) Patent No.: US 6,329,622 B1
(45) Date of Patent: Dec. 11, 2001

(54) OSCILLATING-OPERATION TYPE SWITCH APPARATUS

(75) Inventor: Takeshi Ando, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/558,611

(22) Filed: Apr. 26, 2000

(30) Foreign Application Priority Data

Apr. 28, 1999 (JP) ..... 11-122409

(51) Int. Cl.[7] ..... H01H 19/00
(52) U.S. Cl. ..... 200/537
(58) Field of Search ..... 200/5 A, 6 A, 200/553–557, 339, 512–517, 1 B, 5 R

(56) References Cited

U.S. PATENT DOCUMENTS

Re. 36,349 * 10/1999 Matsumiya et al. ..... 200/6 A
4,349,708 * 9/1982 Asher ..... 200/6 A
4,687,200 * 8/1987 Shirai ..... 200/5 A X
5,621,196 * 4/1997 Nishijima et al. ..... 200/6 A

FOREIGN PATENT DOCUMENTS 2541120 2/1999 (JP) .
2000-315445-A * 11/2000 (JP) ..... H01H/25/04

* cited by examiner

*Primary Examiner*—J. R. Scott
(74) *Attorney, Agent, or Firm*—Brinks Hofer Gilson & Lione

(57) ABSTRACT

A small-sized oscillating-operation type switch apparatus where plural switch devices are selectively on-operated by oscillating operation of an operating body. The apparatus has an operating body oscillate-operated by a user, a support member oscillate-movably supporting the operating body, a flexible substrate with tact switches on-operated by oscillating operation of the operating body, and a fixed plate supporting the operating body, the support member and the flexible substrate. A support shaft as the center of oscillation is perpendicularly provided at the center of a lower surface of the operating body, and four press projections and four connection projections are provided alternately, outside the support shaft, in a circumferential direction at equal 45° intervals. The operating body is displaceably integral with the support member, by providing four elastic arms in the manner of cantilever, with the central sides as fixed ends, on the support member, and welding the respective connection projections to the free end sides of the respective elastic arms.

4 Claims, 7 Drawing Sheets

OSCILLATING-OPERATION TYPE SWITCH APPARATUS

BACKGROUND OF THE INVENTION

1. Field of the Invention

The present invention relates to an oscillating-operation type switch apparatus where plural switch devices such as tact switches or the like are selectively on-operated by oscillate-operating an operating body.

2. Description of the Related Art

As a conventional art of oscillating-operation type switch apparatus of this type, as disclosed in Japanese Published Utility Model Registration No. 2541120, an apparatus where an operating body having plural press projections is oscillate-movably supported on a support member and plural tact switches are provided to be opposite to the respective press projections is known. The tact switches are selectively on-operated by the press projections by oscillate-operating the operating body in an arbitrary direction.

In the oscillating-operation type switch apparatus disclosed in the above publication, an attachment member connected via plural elastic arms is provided at the center of the support member. The operating body is supported displaceably with respect to the support member, by welding four connection projections, provided on a lower surface of the operating body, to the attachment member. The support member is fixed on an upper surface of an outer casing. A support shaft provided at the center of the lower surface of the operating body is in contact with the upper surface of the outer casing, through the attachment member of the support member. Further, four press projections are provided at 90° intervals in a circumferential direction on the lower surface of the operating body. The press projections extend downward through the support member and the outer casing. The respective press projections are located in an outer periphery of the respective connection projections. That is, two connection projections are provided on one straight line connecting the support shaft and two press projections, and on the whole, a couple of connection projection and press projection are provided on the same straight line extending crosswisely from the support shaft as the center. Further, a circuit board is fixed to a lower surface of the outer casing. Plural tact switches opposed to the respective press projections of the operating body are provided on the circuit board.

In the conventional oscillating-operation type switch apparatus schematically having the above structure, when the upper surface of the operating body is depressed and tilted in an arbitrary direction, as the operating body oscillates in the depressed direction with the support shaft as the center, one tact switch is on-operated by its corresponding press projection. Further, when the pressing force to the operating body is removed, the attachment member of the support member returns to a horizontal position by elastic forces of the respective elastic arms, and the operating body fixed to the attachment member automatically returns to an initial position. Accordingly, when a user selects a pressing position on the operating body, one of the four tact switches is selectively on-operated. For example, various operations including menu selection and the like are performed based on operation signals from the respective tact switches.

In the above-described conventional oscillating-operation type switch apparatus, the operating body is supported displaceably with respect to the support member by welding the plural connection projections provided on the operating body to the attachment member of the support member. As two connection projections are provided via the support shaft on the same straight line connecting two press projections, when an arbitrary press projection presses a tact switch in accordance with oscillating operation of the operating body, a force in a direction opposite to a pressing direction acts on a connection projection provided in a position 180° opposite to the press projection via the support shaft, and a strong force occurs in a direction to move the connection projection away from the attachment member. Accordingly, it is necessary to prolong the length of elastic arm as much as possible to reduce the force that acts on the connection projection. As a result, the elastic arms becomes large in a diameter direction, and the diametral size of the operating body attached to the support member having the elastic arms increases, thus the entire oscillating-operation type switch apparatus becomes large.

SUMMARY OF THE INVENTION

According to the present invention, plural press projections and connection projections are provided alternately in a circumferential direction on an operating body, and the respective connection projections are fixed to plural elastic arms provided on a support member. In this structure, even if the respective press projections are provided in positions approached to the center of oscillation, upon oscillate-operation of the operating body, as a force almost does not act between the connection projection and the elastic arm in a direction to move them away from each other, the entire oscillating-operation type switch apparatus, including the operating body and the support member, can be downsized.

According to the present invention, provided is an oscillating-operation type switch apparatus comprising an operating body having plural press projections provided at predetermined intervals in a circumferential direction, a support member oscillate-movably supporting the operating body, and plural switch devices opposed to the respective press projections, the switch devices being selectively operated by the press projections by oscillate-operating the operating body in an arbitrary direction, wherein plural connection projections are provided in the operating body, respectively in an approximately middle position between the respective press projections adjacent to each other in the circumferential direction, and the respective connection projections are fixed to plural elastic arms provided on the support member.

In this structure, even if the respective press projections are provided in positions approached to the center of oscillation, upon oscillate-operation of the operating body, as a force almost does not act between the connection projection and the elastic arm in a direction to move them away from each other, the entire oscillating-operation type switch apparatus, including the operating body and the support member, can be downsized.

In the above structure, it is preferable for downsizing that the respective elastic arms are provided in the manner of cantilever on the support member, and free end sides are extended radially from sides in a central portion of the support member as a starting point, and the respective connection projections are fixed to the free end sides of the respective elastic arms. In this case, as the respective connection projections are fixed to the free end sides of the respective cantilever elastic arms sufficiently away from the center of oscillation of the operating body, the respective elastic arms can be comparatively greatly elastically-deformed independently, and the force that acts between the connection projection and the elastic arm in a direction to move them away from each other can be further reduced.

Further, in the above structure, it may be arranged such that openings or notches, through which the respective press projections are inserted, are provided in a plate portion of the support member, and the respective elastic arms are extended upward with respect to an upper surface of the plate portion. In this case, as the amount of elastic deformation of each elastic arm can be increased, a pressing stroke upon oscillating-operation of the operating body can be set to a large value.

Further, in the above structure, it may be arranged such that a snap leg is perpendicularly positioned in a central portion of the support member and plural bosses are perpendicularly positioned around the snap leg, and the snap leg is snap-fixed, and the respective bosses are swaged, to a fixed plate carrying a switch device. In this case, assembly work of the oscillating-operation type switch apparatus can be easily made, and the constituent parts such as the operating body and the support member can be stably supported.

BRIEF DESCRIPTION OF THE DRAWINGS

The accompanying drawings, which are incorporated in and constitute a part of the specification, illustrate preferred embodiment of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

The oscillating-operation type switch apparatus as shown in the figures has an operating body 1 oscillate-operated by a user, a support member 2 oscillate-movably support the operating body 1, a flexible substrate 3 having switch devices operated by oscillating operation of the operating body 1, and a fixed plate 4 supporting the operating body 1, the support member 2 and the flexible substrate 3.

Figure 4:
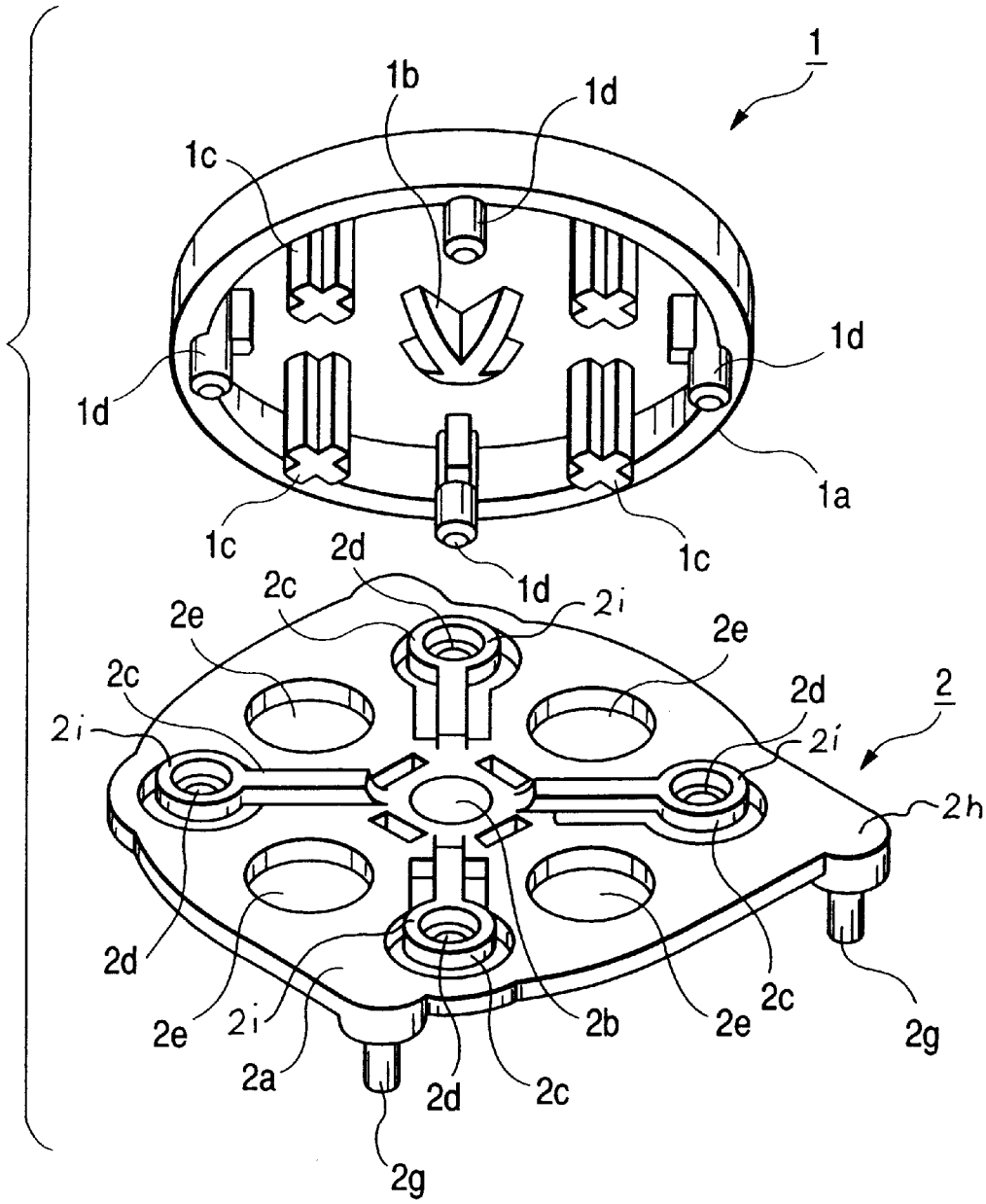
FIG. 4 is an exploded perspective view of an operating body and a support member.
Figure 5:
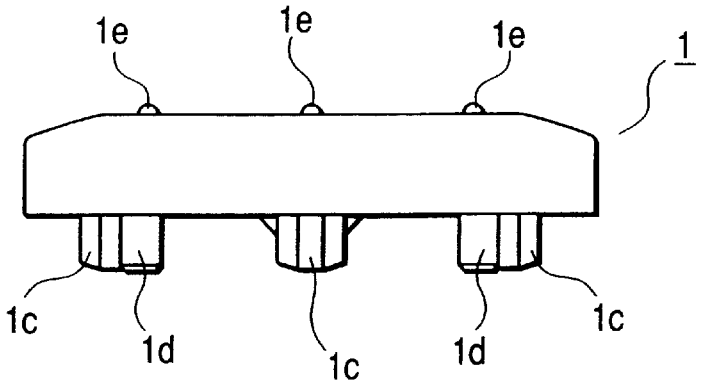
FIG. 5 is a side view of the operating body.
Figure 6:
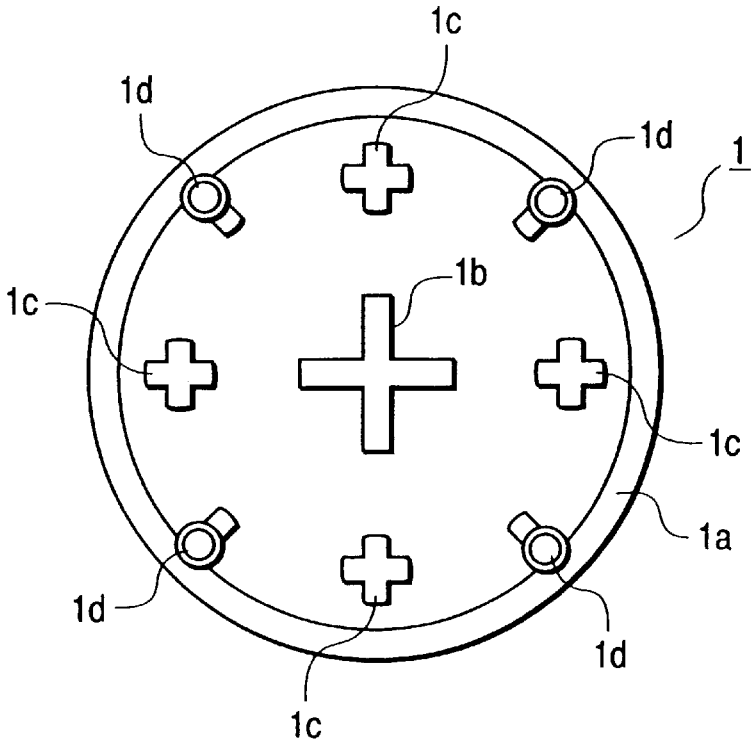
FIG. 6 is a rear view of the operating body.
Figure 7:
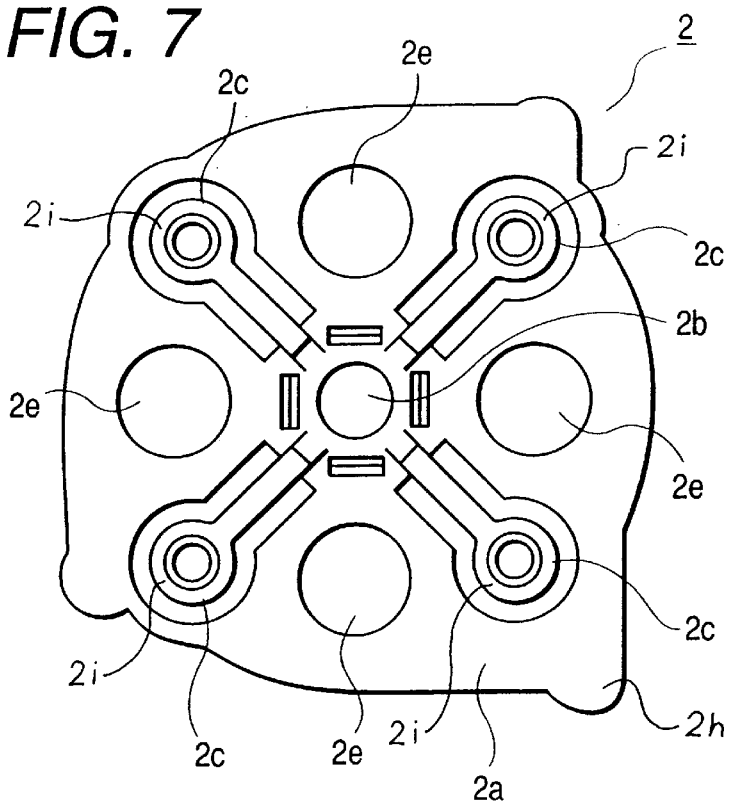
FIG. 7 is a plan view of the support member.
Figure 8:
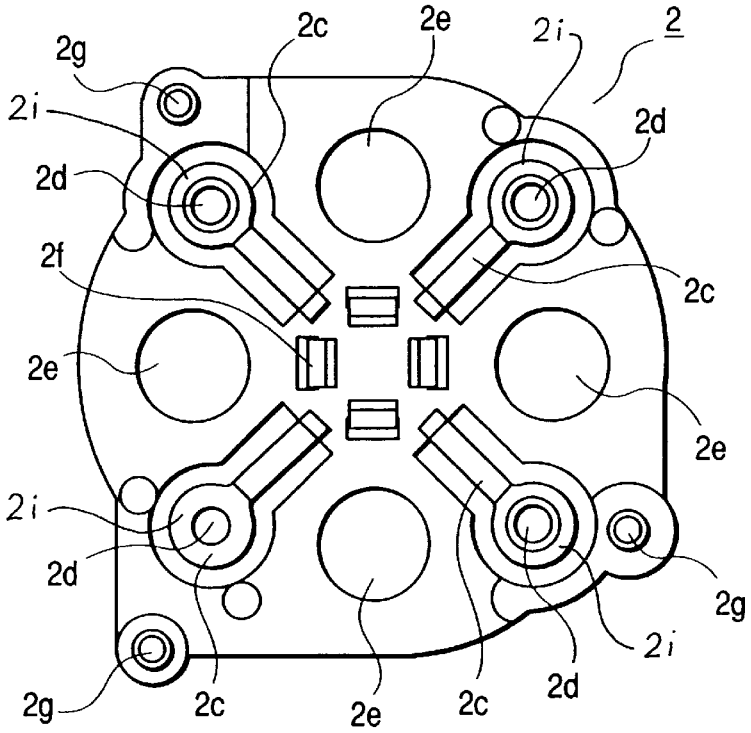
FIG. 8 is a rear view of the support member.
Figure 9:
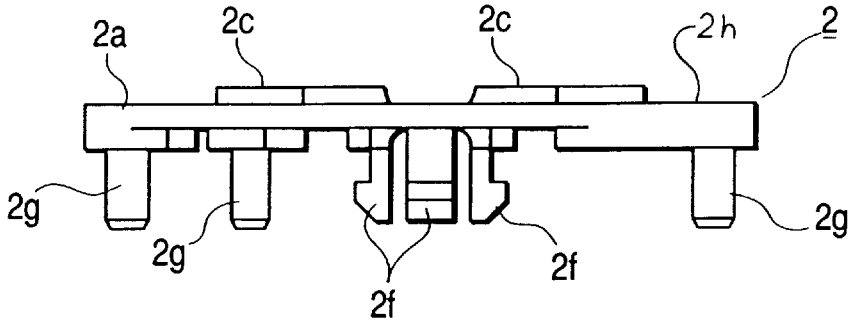
FIG. 9 is a side view of the support member.

The operating body 1, formed with synthetic resin, has an upper surface as a round operation surface. As shown in FIGS. 4 to 6, a circular member 1*a* is perpendicularly provided on an outer circumferential edge of the operating body 1. A support shaft 1*b*, four press projections 1*c*, and four connection projections 1*d* are respectively perpendicularly provided on a lower surface of the operating body 1. The support shaft 1*b* is provided at the center of the circular member 1*a*. The outer surface of the support shaft 1*a* is a curved surface, and has a cross shape with notched four corners, viewed from the bottom surface. The respective press projections 1*c* are provided inside the circular member 1*a* at equal 90° intervals. On the operation surface of the operating body 1, finger pads 1*e* are projected in positions opposed to the respective press projections 1*c*. The respective connection projections 1*d* are provided along an inner circumferential edge of the circular member 1*a* at equal 90° intervals. Viewed in a circumferential direction, the press projections 1*c* and the connection projections 1*d* are alternately provided at equal 45° intervals.

The support member 2, also formed with synthetic resin, has a plate member 2*a* somewhat larger than the operating body 1 as shown in FIG. 4 and FIGS. 7 to 9. A dish-shaped concave member 2*b* is formed at the center of an upper surface 2*h* of the plate member 2*a*, and four elastic arms 2*c* are extended crosswisely from the concave member 2*b* as the center. Each elastic arm 2*c* is supported in the manner of a cantilever with the concave member 2*b* side as a fixed end, and a hole 2*d* is formed in a free end 2*i*. The elastic arms 2*c* project somewhat upward with respect to the upper surface 2*h* of the plate member 2*a*. Further, four openings 2*e* formed in the plate member 2*a*. Each opening 2*e* is provided in a middle position between the respective elastic arms 2*c*. Viewed in the circumferential direction, the elastic arms 2*c* and the openings 2*e* are alternately provided at equal 45° intervals. Further, four snap legs 2*f* are perpendicularly provided at the central portion of the lower surface of the plate member 2*a*. Three bosses 2*g* are perpendicularly provided in peripheral positions of the lower surface of the plate member 2*a*.

Figure 10:
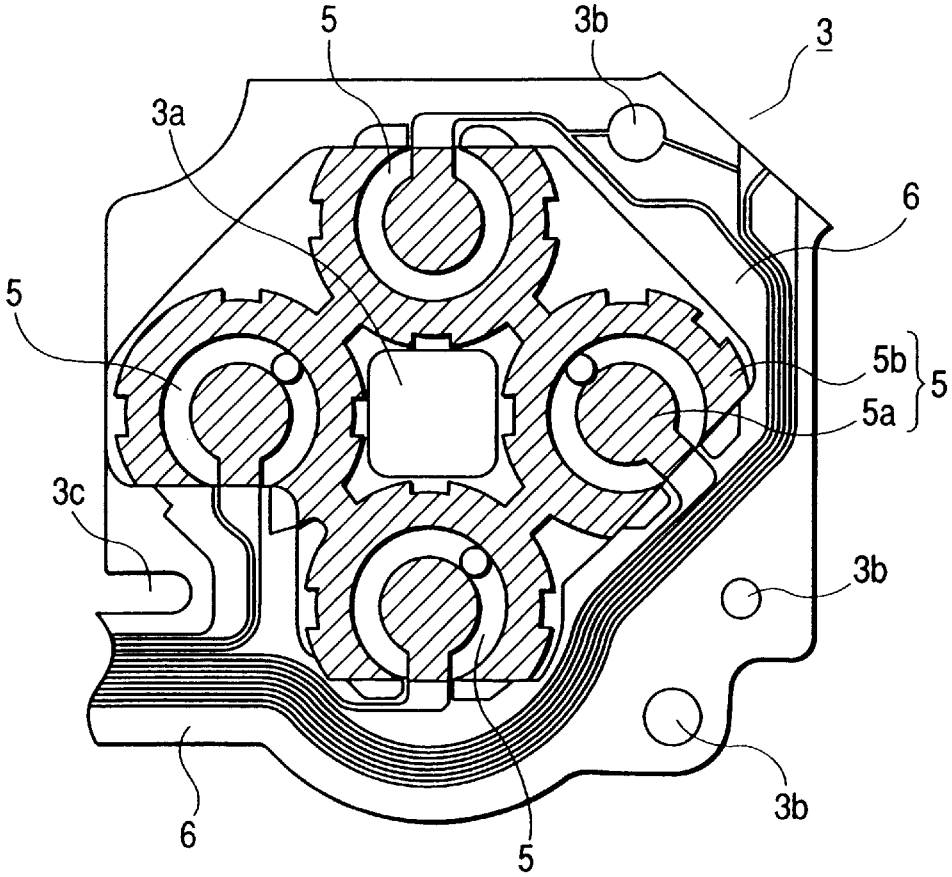
FIG. 10 is a plan view of a flexible substrate.

As shown in FIG. 10, an opening 3*a* is formed in the flexible substrate 3, and four sets of fixed contacts 5 are formed around the opening 3*a*. The fixed contacts 5, each having a central fixed contact 5*a* and a peripheral fixed contact 5*b*, are provided in the circumferential direction at equal 90° intervals. An insulating film 6, covering a wiring pattern of the respective fixed contacts 5 is attached to the flexible substrate 3. Dome-shaped tact springs 7 to raise click feeling upon reversal are provided on the respective peripheral fixed contacts 5*b* (See FIG. 2). The respective tact springs 7 function as movable contacts. These tact springs 7 (movable contacts) and the fixed contacts 5 constitute four tact switches. Note that three holes 3*b* and one notch 3*c* are formed in the flexible substrate 3, and the respective tact springs 7 are fixed by adhesive tapes (not shown) to the flexible substrate 3.

Figure 11:
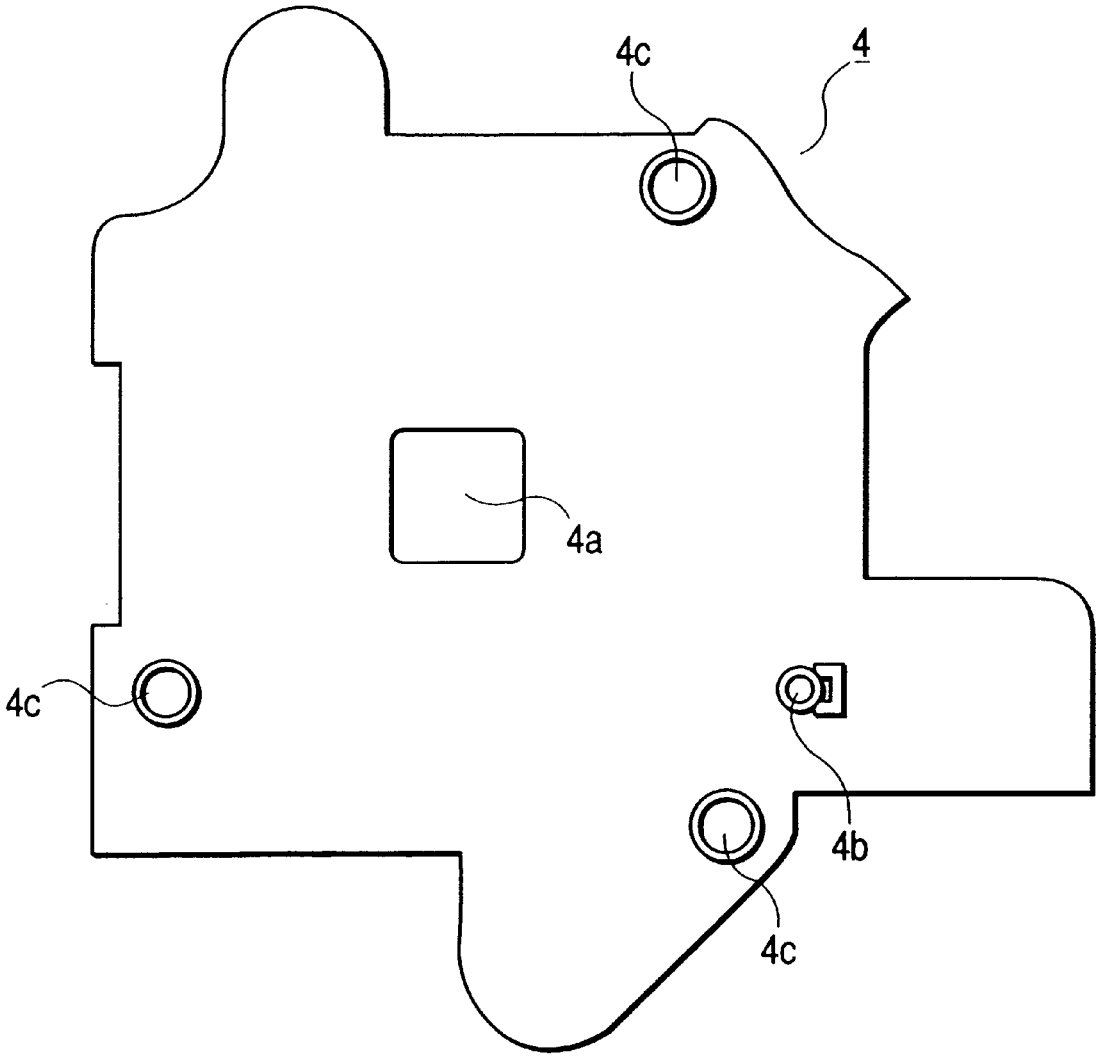
FIG. 11 is a plan view of a fixed plate.

As shown in FIG. 11, a rectangular-shaped opening 4*a* is formed at the center of the fixed plate 4, and one boss 4*b* and three holes 4*c* are formed in peripheral positions of the fixed plate 4. The fixed plate 4 is also formed with synthetic resin, however, it may be a metal plate if desired rigidity can be ensured.

Figure 1:
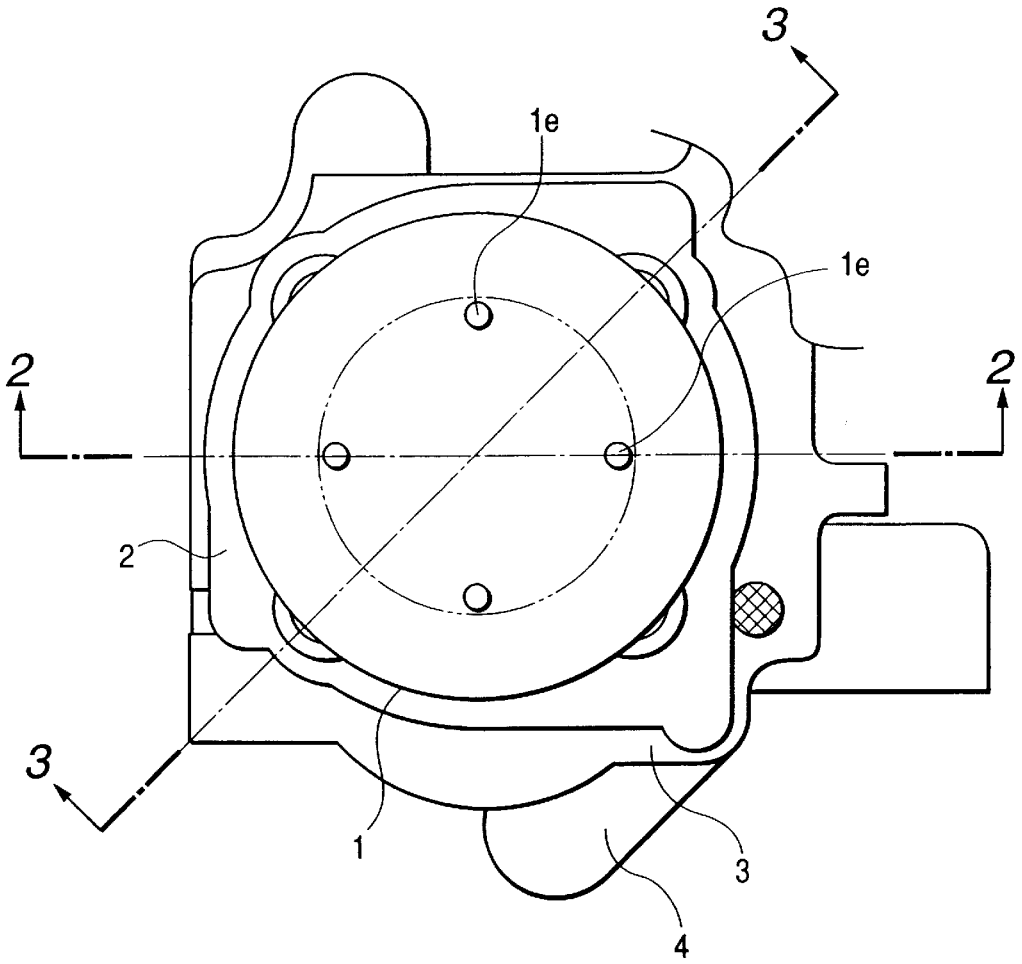
FIG. 1 is a plan view of an oscillating-operation type switch apparatus according to an embodiment of the present invention.
Figure 2:
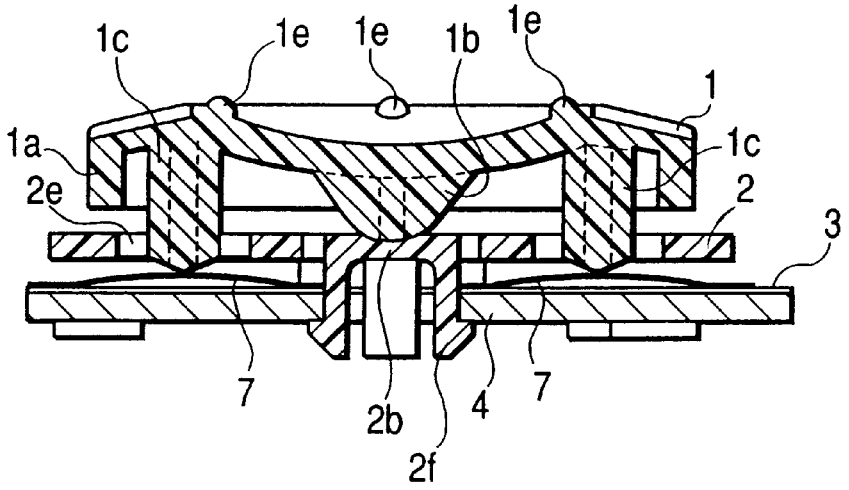
FIG. 2 is a cross-sectional view along a line 2—2 in FIG. 1.
Figure 3:
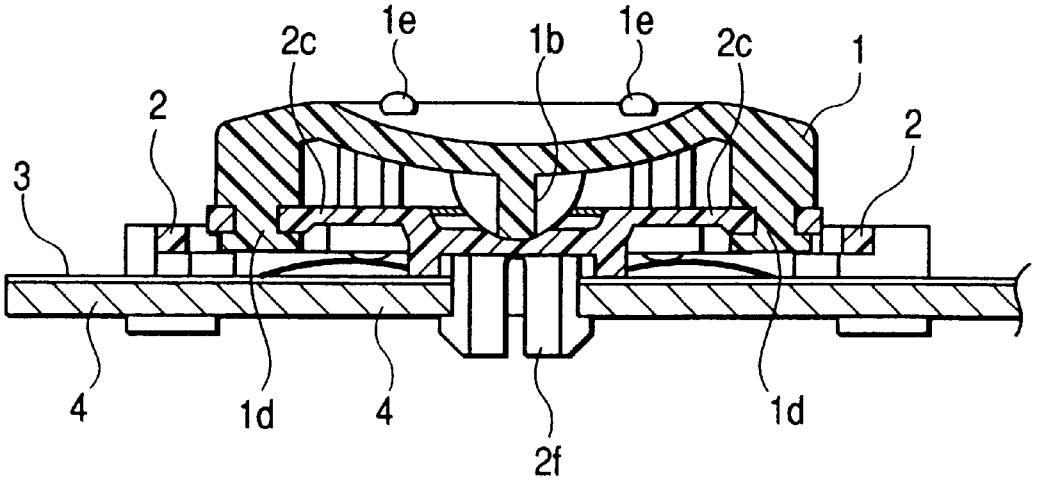
FIG. 3 is a cross-sectional view along a line 3—3 in FIG. 1.

As shown in FIGS. 1 to 3, the flexible substrate 3 is fixed onto the fixed plate 4 by inserting one hole 3*b* of the flexible substrate 3 into the boss 4*b* of the fixed plate 4, and welding an upper end of the boss 4*b* (a hatched portion in FIG. 1). As described above, the four tact springs 7 are fixed onto the flexible substrate 3, and the respective fixed contacts 5 and the respective tact springs 7 on the flexible substrate 3 construct four tact switches. On the other hand, the operating body 1 is integral with the support member 2 via the respective elastic arms 2*c*, by thrusting the support shaft 1*b* of the operating body 1 against the concave member 2*b* of the support member 2 then inserting the respective connection projections 1*d* into the holes 2*d* of the respective elastic arms 2*c*, and fixing the lower ends of the connection projections 1*d* to the respective elastic arms 2*c* by welding, cold swaging or the like. In this arrangement, the operating body 1 is oscillate-movably supported with the concave member 2*b* of the support member 2 as the center, and the respective press projections 1*c* of the operating body 1 are inserted into the respective openings 2*e* of the support member 2. Then, the support member 2 is fixed to the fixed plate 4 via the flexible substrate 3, by snapping the respective snap legs 2*f* of the support member 2, through the opening 3*a* of the flexible substrate 3, to the periphery of the opening 4*a* of the fixed plate 4, and welding the respective bosses 2*g* of the support member 2 through the two holes 3*b* and the notch 3*c* of the flexible substrate 3 to the respective holes 4*c* of the fixed plate 4. In this state, the lower ends of the respective press projections 1*c* of the operating body 1 are in contact with the top portion of the respective tact springs 7.

Next, the operation of the oscillating-operation type switch apparatus having the above structure will be described. FIGS. 2 and 3 show a unloaded state where the operating body 1 is not tilted in any direction. In this unloaded state, the operating body 1 is held in the horizontal position by elastic returning forces from the respective tact springs 7 and the respective elastic arms 2*c*.

When the user depresses an arbitrary position of the operation surface of the operating body 1, e.g., a left end of the operating body 1 in FIG. 2, the operating body 1 oscillates in a counterclockwise direction with a contact point between the supporting shaft 1*b* and the concave member 2*b* of the support member 2 as the center, and in accordance with the oscillation, the press projection 1*c* on the left side of the figure moves downward in the opening 2*e* of the support member 2. At this time, as the two connection projections 1*d*, in opposite positions via the press projection 1*c* and the support shaft 1*b*, move somewhat upward with the elastic arm 2*c*. However, as the two connection projections 1*d* are provided shifted by about 45 in the circumferential direction with respect to a straight line connecting the press projection 1*c* and the support shaft 1*b*, a force large enough to move the connection projections 1*d* from the elastic arm 2*c* does not act. When the press projection 1*c* has moved downward by a predetermined amount, as the central portion of tact spring 7 opposed to the press projection 1*c* is reversed to electrically connect the central fixed contact 5*a* and the peripheral fixed contact 5*b* of the fixed contact 5, upon raise of click feeling, the switch status changes from switch-off to switch-on. Further, in such switch-on state, when the above pressing force to the operating body 1 is removed, the operating body 1 returns to the horizontal position by self-returning forces of the tact spring 7 and the elastic arm 2*c*. Then the switch-on state tact switch enters the switch-off state. Further, when the user depresses another position of the operating body 1, a similar operation is performed. In this case, the press projection 1*c* immediately under the depressed position on-operates the tact switch opposed to the projection. Note that when the user depresses an arbitrary position of the operating body 1, as finger pads 1*e* corresponding to the respective press projections 1*c* are projected on the operation surface of the operating body 1, even if the operation surface of the operating body 1 is downsized to be covered with the user's finger, the user can easily recognize depressed positions by touching the respective finger pads 1*e*.

In this manner, in the oscillating-operation type switch apparatus according to the present preferred embodiment, the plural press projections 1*c* and the plural connection projections 1*d* are provided in the circumferential direction at predetermined intervals on the operating body 1, and the respective connection projections 1*d* are fixed to the plural elastic arms 2*c* provided on the support member 2 by welding or the like. Accordingly, even if the respective press projections 1*c* are provided in positions approached to the center of oscillation of the operating body 1, upon oscillate-operation of the operating body 1, as a force almost does not act between the connection projection 1*d* and the elastic arm 2*c* in a direction to move them away from each other, the entire oscillating-operation type switch apparatus, including the operating body 1 and the support member 2, can be downsized. Further, as the respective elastic arms 2*c* are cantilever shaped and radially extended from the oscillation center sides as fixed ends, and the connection projections 1*d* are fixed to the free end sides 2*i* of the elastic arms 2*c*, the respective connection projections 1*d* are sufficiently away from the center of oscillation of the operating body 1. Thus, the force that acts between the connection projection 1*d* and the elastic arm 2*c* in a direction to move them away from each other can be further reduced.

Further, in the present preferred embodiment, as the respective elastic arms 2*c* provided on the support member 2 are extended upward with respect to the upper surface 2*h* of the plate member 2*a*, the respective elastic arms 2*c* can be elastically-deformed by a large displacement amount with respect to the plate member 2*a*. Thus the pressing stroke upon oscillating-operation of the operating body 1 can be set to a large value.

Further, in the present preferred embodiment, as the snap legs 2*f* provided in the central portion of the lower surface of the support member 2 are snapped to the opening 4*a* of the fixed plate 4 and the plural bosses 2*g* provided on the peripheral edge of the lower surface of the support member 2 are swaged to the respective holes 4*c* of the fixed plate 4, assembly work of the oscillating-operation type switch apparatus can be easily made, and the constituent parts such as the operating body 1 and the support member 2 can be stably supported.

Note that in the above preferred embodiment, as one example of the switch devices operated by the respective press projections 1*c*, tact switches using the tact springs 7 as movable contacts are employed, however, it may be arranged such that a device, having a pair of films respectively having a fixed contact and a movable contact such as a membrane switch, is used, and the tact spring 7 is mounted on the membrane switch, i.e., the movable contact is provided separately from the tact spring 7. Further, it may be arranged such that a rigid substrate is used in place of the flexible substrate 3 and the rigid substrate functions as a fixed plate.

Further, in the above preferred embodiment, the support member 2 has openings 2*e* through which the press projections 1*c* are inserted, however, the openings 2*e* may be notches.

Further, in the above preferred embodiment, the support shaft 1*b* is provided at the center of the lower surface of the operating body 1, and the support shaft 1*b* is in contact with the concave member 2*b* of the support member 2 as the center of oscillation, however, it may be arranged such that the support shaft 1*b* of the operating body 1 is longer and is inserted into a hole provided at the center of the support member 2, and the support shaft 1*b* is supported by the fixed plate 4 which does not have the opening 4*a*. Further, it may be arranged such that the support shaft 1*b* is not provided on the operating body 1 but is projected from the center of the upper surface 2*h* of the support member 2, and the support shaft is in contact with the rear surface of the operating body 1.

Note that the present invention is especially advantageous when applied to an apparatus having three or more press projections and switch devices.

The present invention is implemented in the form as described above, and has effect as follows.

In the oscillating-operation type switch apparatus comprising an operating body having plural press projections provided at predetermined intervals in a circumferential direction, a support member oscillate-movably supporting the operating body, and plural switch devices opposed to the respective press projections, wherein the switch devices are selectively operated by the press projections by operating the oscillate-operating body in an arbitrary direction, plural connection projections are provided on the operating body, respectively in approximately middle position between the respective press projections adjacent to each other in the circumferential direction, and the respective connection projections are fixed to plural elastic arms provided on the support member. In this structure, even if the respective press projections are provided in positions approached to the center of oscillation, upon oscillate-operation of the operating body, as a force almost does not act between the connection projection and the elastic arm in a direction to move them away from each other, the entire oscillatingoperation type switch apparatus, including the operating body and the support member, can be downsized.

As many apparently widely different preferred embodiments of the present invention can be made without departing from the spirit and scope thereof, it is to be understood that the invention is not limited to the specific preferred embodiments thereof except as defined in the appended claims.

What is claimed is:

1. An oscillating-operation type switch apparatus comprising: an operating body having plural press projections provided at predetermined intervals in a circumferential direction and plural connection projections; a support member supporting the operating body such that the operating body is oscillatable; and plural switch devices opposed to said press projections, said switch devices being selectively operated by said press projections by operating said operating body in an arbitrary direction, wherein the plural connection projections are provided in an approximately middle position between said respective press projections adjacent to each other in the circumferential direction, and the respective connection projections are fixed to plural elastic arms provided on said support member.

2. The oscillating-operation type switch apparatus according to claim 1, wherein each of said elastic arms forms a cantilever with a fixed end and a free end, a central portion of said support member is connected with the fixed end of each of the elastic arms, and wherein said connection projections are respectively fixed to the free end of said elastic arms.

3. The oscillating-operation type switch apparatus according to claim 2, wherein openings, through which said respective press projections are inserted, are provided in a plate portion of said support member, and wherein said elastic arms are disposed above an upper surface of the plate portion when in an unoperated position.

4. The oscillating-operation type switch apparatus according to claim 3, wherein a snap leg is perpendicularly positioned in the central portion of said support member and plural bosses are perpendicularly positioned around said snap leg, and wherein said snap leg is snap-fixed, and said bosses are swaged, to a fixed plate carrying a switch device.

* * * * *